313-414 SR
7/8/86 OR 4,599,534

United States Patent [19]
Shirai et al.

[11] Patent Number: 4,599,534
[45] Date of Patent: Jul. 8, 1986

[54] ELECTRON GUN FOR COLOR PICTURE TUBE

[75] Inventors: Shoji Shirai, Koganei; Masaaki Yamauchi, Togane; Yoshiaki Iidaka, Chiba; Hiroshi Takano, Hachioji; Masakazu Fukushima, Tokyo, all of Japan

[73] Assignee: Hitachi, Ltd., Tokyo, Japan

[21] Appl. No.: 612,810

[22] Filed: May 22, 1984

[30] Foreign Application Priority Data

May 23, 1983 [JP] Japan ..... 58-89132

[51] Int. Cl.[4] ..... H01J 29/62
[52] U.S. Cl. ..... 313/414
[58] Field of Search ..... 313/414, 413, 412, 448, 313/449

[56] References Cited

U.S. PATENT DOCUMENTS 4,400,649 8/1983 Chen ..... 313/414
4,517,488 5/1985 Say ..... 313/414

FOREIGN PATENT DOCUMENTS 0063750 4/1982 Japan ..... 313/414

*Primary Examiner*—Palmer C. DeMeo
*Attorney, Agent, or Firm*—Antonelli, Terry & Wands

[57] ABSTRACT

An electron gun for a color picture tube is disclosed in which three parallel electron beams emitted toward a fluorescent screen and arranged so as to define one and the same plane are focused on the fluorescent screen by a main lens, electrodes constituting the main lens are spaced apart from each other, the electrodes include at least two envelopes and electrode plates disposed at the confronting end faces of the envelopes, each of the electrode plates has a single aperture for transmitting a central one of the electron beams, the path of each outer electron beam is surrounded partly by one of end portions of each electrode plate, and at least one of the electrode plates is placed in a corresponding one of the envelopes such that the electrode plate is recessed from the end face of the corresponding envelope confronting the other envelope.

17 Claims, 7 Drawing Figures

ELECTRON GUN FOR COLOR PICTURE TUBE

BACKGROUND OF THE INVENTION

The present invention relates to an electron gun used in a color picture tube, particularly an in-line electron gun, and more particularly to the structure of electrodes forming the main lens of the electron gun.

One of factors which have a great influence on the focussing characteristics of a color picture tube, is the aperture diameter of the main lens of the electron gun. In order to obtain satisfactory focussing characteristics, it is desirable to make the aperture diameter of the main lens as large as possible.

However, in an in-line gun system, three electron guns for green, blue, and red are arranged on one and the same horizontal plane and united in one body. Such an inline electron gun is placed in a neck tube which has a limited inner diameter. Accordingly, the diameter of lenses formed in the electron guns and the interval of the lenses are restricted by the diameter of the neck tube, and thus it is very difficult to make large the aperture diameter of these lenses. The above problems will be explained below in more detail.

The focusing characteristics of a picture tube are greatly affected by the magnification and aberration of the main lens, which depend strongly upon the converging effect of the lens. In the picture tube, once the scanning area and maximum deflection angle of the electron beam are given, the distance from the main lens to the focal surface is determined. If the converging effect of the lens is weakened under the condition that the distance from the main lens to the focal surface is constant, the magnification of the lens will be reduced. Further, if another condition that the spread of the electron beam in the main lens is made less than a certain value, is added to the abovementioned condition to prevent the deflection aberration from increasing, the incident angle of the electron beam at the main lens must be reduced. The diameter $\delta$ of the disk of the least confusion caused by the spherical aberration which is most dominant in aberrations of the main lens, is given as follows:

$$\delta = \tfrac{1}{2} M C_{sp} \alpha_i^3$$

where $\alpha_i$ is the incident angle of the electron beam, M the lens magnification, and $C_{sp}$ the coefficient of spherical aberration. It is known from the above equation that the spherical aberration can be reduced by reducing the incident angle of the electron beam.

As mentioned above, by weakening the converging effect of the main lens, the lens magnification and spherical aberration can be reduced, and thus the focusing characteristics can be improved. One method for weakening the converging effect is to provide larger diameters for the apertures of G3 and G4 electrodes constituting the main lens.

However, the in-line electron gun includes three lenses for red, green, and blue, and these lenses are arranged on a horizontal plane. Accordingly, the diameter of apertures for forming these lenses is required to be less than one-third of the inner diameter of the neck portion of a glass envelope accomodating the electron gun. The allowable value of the above aperture diameter will further be reduced when the thickness of the electrode and the machining accuracy thereof are considered. If the inner diameter of the neck portion is increased to make large the above-mentioned allowable value, the deflection power will increase. In general, the enlargement of aperture diameter increases the distance between the axes of the apertures, therefore, the distance S between electron beams, and deteriorates the converging characteristics. Taking these matters into account, the aperture diameter has been made as large as possible in a limited range, and it is very difficult to further increase the aperture diameter.

SUMMARY OF THE INVENTION

It is accordingly an object of the present invention to provide an electron gun for a color picture tube which can eliminate the halo from an outer electron beam and can improve the resolution of the color picture tube, by making the effective lens dimension for an outer portion of the outer electron beam, as large as possible.

In order to attain the above object, according to the present invention, there is provided an electron gun for a color picture tube, in which a main lens is formed of a pair of electrodes, each of the electrodes is made up of an electrode plate and an envelope, right and left end portions in contact with the envelope are removed from the electrode plate, only an aperture for transmitting a central electron beam is provided in each electrode plate, each electrode plate is placed in a corresponding one of the envelopes to partly close the opening of the envelope, the path of the central electron beam passes through the aperture of each eleotrode plate, the path of each of outer electron beams is surrounded by each envelope and one end portion of each electrode plate. Accordingly, in the abovementioned electron gun, the horizontal dimension of an outer lens for an outer electron beam is determined by the distance between the outer electron beam and the envelope, and can take a maximum value for the envelope having predetermined dimensions.

BRIEF DESCRIPTION OF THE DRAWINGS

The present invention will be apparent from the following detailed description taken in conjunction with the accompanying drawings, in which.

DESCRIPTION OF THE PREFERRED EMBODIMENTS

The present invention is directed to an electron gun for the case where the dimensions of the main lens are restricted by the inner diameter of the neck portion of a color picture tube, that is, an electron gun for a color picture tube which can increase the effective diameter of the main lens without making large the dimensions thereof, and thus can improve the focusing characteristics.

Figure 1:
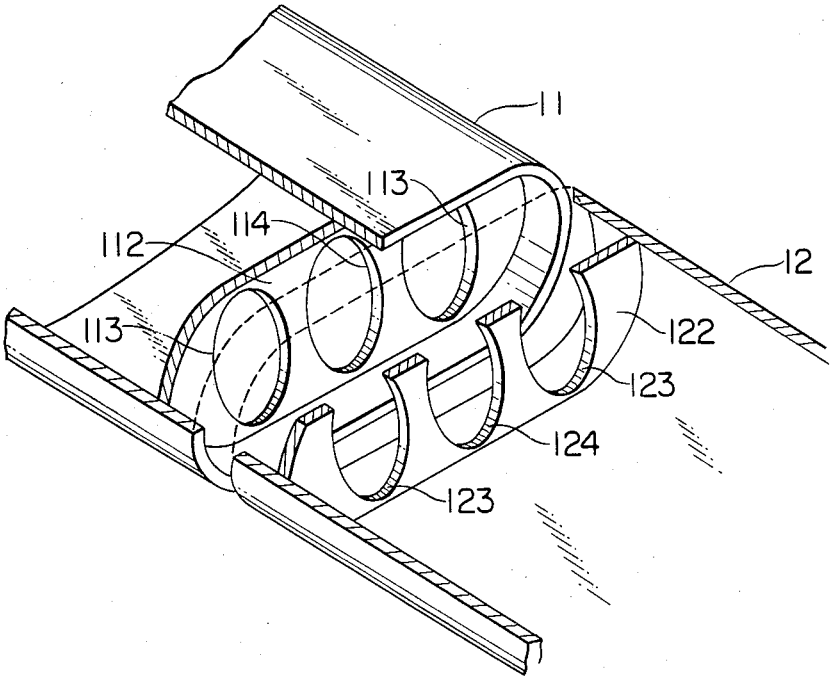
FIG. 1 (PRIOR ART)
FIG. 1 is a partially cutaway view in perspective of an example of a main lens which is formed in an electron gun and has enlarged effective dimensions.

In a U.S. patent application Ser. No. 448,601 filed Dec. 10, 1982 (Japanese patent application Ser. No. 201617/81), there is disclosed a method for enlarging the effective diameter of the aperture over the above-mentioned limit. Prior to explaining the present invention, this method will be briefly explained. FIG. 1 is a partially cutaway view in perspective of a main lens disclosed in the above-referred U.S. patent application. Referring to FIG. 1, electrode plates 112 and 122 constituting the confronting surfaces of a G3 electrode 11 and a G4 electrode 12 are recessed from each other. Since the confronting surfaces which have a shielding effect are recessed, the electric field penetrates deep into the space surrounded by the G3 electrode and the space surrounded by the G4 electrode. And accordingly, the lens region is extended in the axial direction. Such extension has the same effect as the enlargement of the apertures in the confronting surfaces. That is, the effective diameter of the main lens is increased. However, the cross-section of the envelopes is not circular in shape, but has a horizontal dimension larger than the vertical dimension. Accordingly, the effective diameter in the horizontal direction is made larger than that in the vertical direction. Thus, the horizontal focusing effect of the lens becomes weaker than the vertical focusing effect, and therefore the astigmatism is generated in focusing the electron beam. In order to solve this problem, apertures 113, 114, 123, and 124 provided in the electrode plates 112 and 122 have a non-circular shape, that is, the horizontal dimension of each aperture is made smaller than the vertical dimension thereof. Thus, the penetration of electric field in the horizontal direction is suppressed, and the horizontal and vertical focusing effects of each of three lenses are made equal to each other, thereby eliminating astigmatism.

Figure 2:
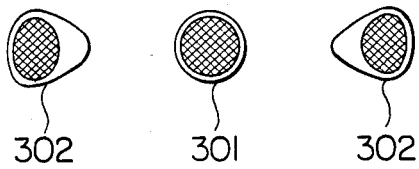
FIG. 2 is a view showing the beam spots formed by electron beams which have been converged by the main lens shown in FIG. 1.

The upper limit of the effective dimension of the main lens having the above-mentioned structure is restricted by the distance from the electron beam to the envelope. In the case where the distance S between electron beams is large, a minimum value of the distance from the electron beam to the envelope is given by the distance between an outer electron beam and a semicylindrical end portion of the envelope. Accordingly, the effective dimension of the main lens is restricted by the outer electron beams. On this account, it is required to make the effective dimension of two outer lenses as large as possible. However, this dimension is restricted not only by the distance between the outer electron beam and the semicylindrical end portion of the envelope, but also by the presence of the electrode plates 112 and 122. In other words, when the amount of recess of each of the electrode plates 112 and 122 is increased and the dimensions of each of the elliptical apertures 113, 114, 123, and 124 are enlarged, for the purpose of increasing the dimension of the main lens, beam spots such as shown in FIG. 2 are formed on a fluorescent screen. In FIG. 2, a hatched area indicates a high brightness portion which is called a core, and an empty area indicates a low brightness portion which is called a halo. As shown in FIG. 2, a central electron beam 301 has a substantially circular cross section. While, in outer electron beams 302, the halo extends inward. This is because the effective dimension of the lens for an outer portion of each outer electron beam is small and the focusing effect of the lens on the outer portion is strong. The generation of such a halo reduces the resolution of the color picture tube.

The above-mentioned problems are explained with reference to the drawings.

Figure 3:
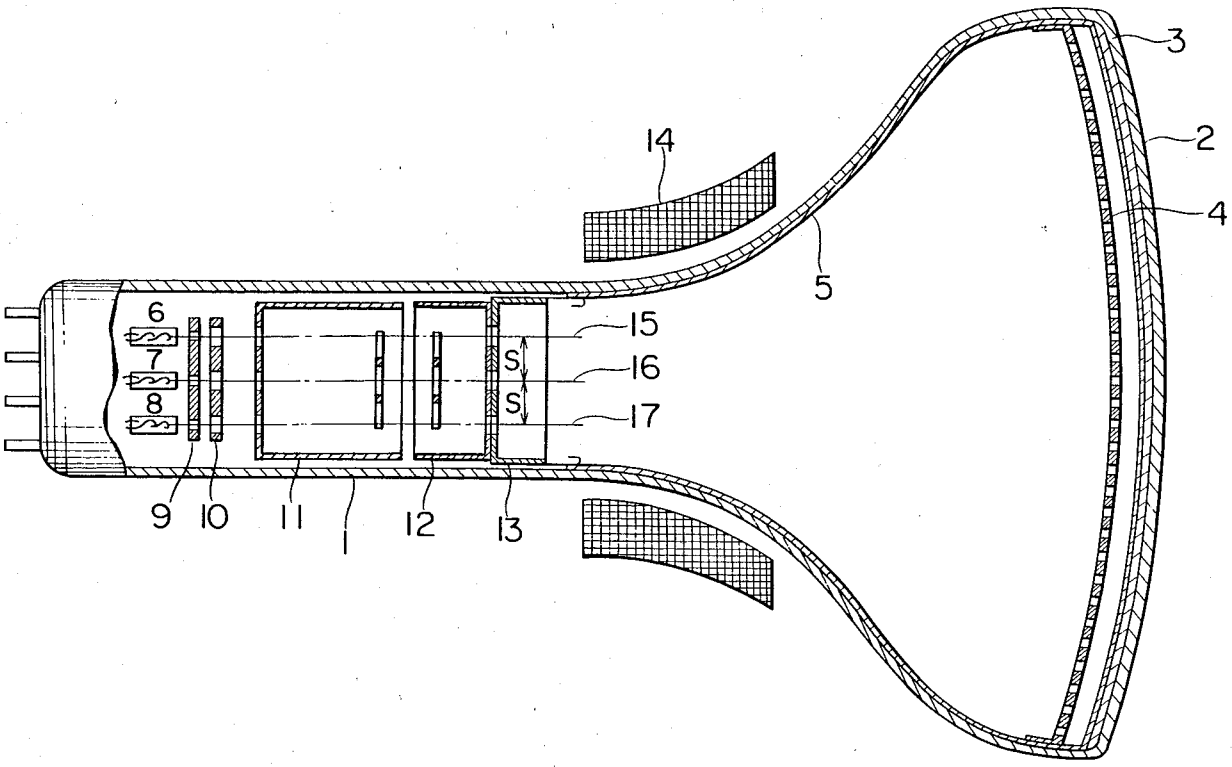
FIG. 3 is a horizontal sectional view showing the outline of an in-line type color picture tube.

FIG. 3 is horizontal sectional view of a color picture tube. Referring to FIG. 3, on the inner wall of a face plate 2 included in a glass envelope 1, there is supported a fluorescent screen 3 which is coated with three color phosphors one after another to form stripes. Electron beams from cathodes 6, 7 and 8 pass through corresponding apertures provided in each of a G1 electrode 9 and a G2 electrode 10, and then travel along axes 15, 16 and 17, respectively. Each cathode and corresponding apertures of the G1 and G2 electrodes have the same center axis, and three center axes coincide with the axes 15, 16 and 17. These center axes are disposed on a common plane and are substantially parallel to each other. A direction along the above plane is hereinafter called the horizontal direction. Three electron beams emitted from the cathodes travel along the center axes 15, 16 and 17, and enter a main lens which is formed of a G3 electrode 11 and a G4 electrode 12. Details of the main lens will be described later. The G3 electrode 11 is applied with a lower potential than the potential of the G4 electrode 12 which is kept in equipotential with a shield cup 13 and a conductive coating 5 provided on the inner wall of the glass envelope 1. The central beam is focused by the central lens, and then takes a straight path along the axis 16. Outer beams are subjected to not only the focusing effect of the lenses but also a converging force toward the central beam. Thus, the three electron beams are focused on a shadow mask 4 in an overlapping fashion. This operation for converging three electron beams is called static convergence (hereinafter simply referred to as "STC"). The electron beams are further subjected to color selection by the shadow mask 4 so that only components for illuminating fluorescent materials of colors corresponding to the electron beams pass through holes in the shadow mask and reach the fluorescent screen. Further, in order to scan the electron beams on the fluorescent screen, an external magnetic deflection yoke 14 is provided around the glass envelope 1.

Now, the electrode structure of the main lens, that is, the essential part of the present invention will be explained below in detail.

Figure 4:
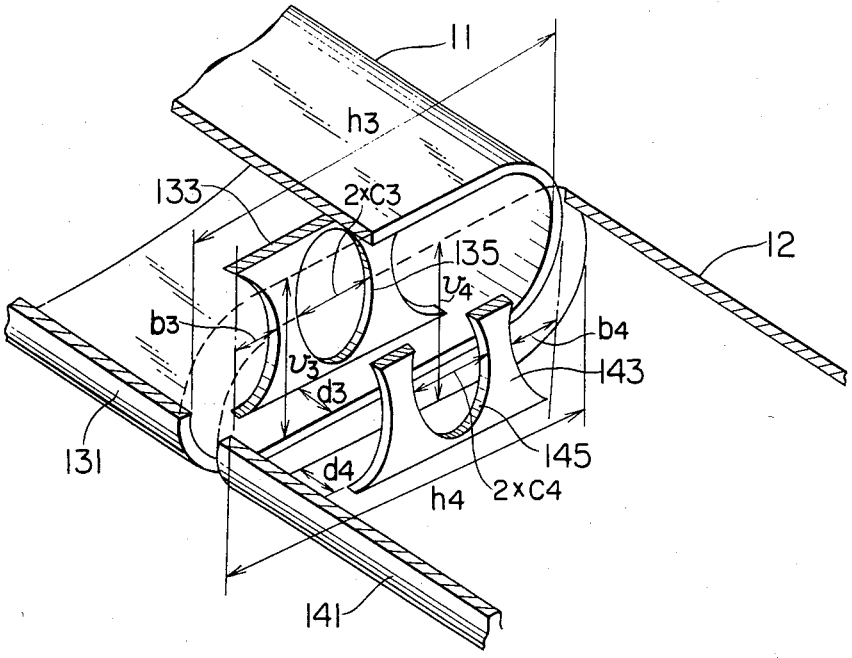
FIG. 4 is a partially cutaway view in perspective of a principal portion of a first embodiment of an electron gun according to the present invention.

FIG. 4 is a partially cutaway view in perspective of a main lens portion of a first embodiment of an electron gun according to the present invention. Referring to FIG. 4, elliptical apertures 135 and 145 for the central beam are provided in electrode plates 133 and 143, respectively. While, an elliptical aperture for an outer beam is divided into two halves, and the half in contact with the envelope 131 or 141 is removed. In other words, the apertures 135 and 145 provided in the electrode plates 133 and 143 serves as the path of the central beam, and the path of each outer beam is surrounded partly by an end portion of the electrode plate 133 or 143 and partly by the envelope 131 or 141. Accordingly, the dimension of the lens for the outer beam can take the largest value. Further, since each electrode plate is small in area, it is easy to enhance the flatness of the electrode plate. Furthermore, two semielliptical apertures which require a high machining accuracy, are removed from each electrode plate. Therefore, the machining of the electrode plate becomes easy.

Actual dimensions of the present embodiment will be described below, by way of example. Incidentally, the dimensions with respect to the G3 electrode and those with respect to the G4 electrode will be indicated by suffix 3 and 4, respectively.

Referring to FIG. 4, one-half of the minor axis of the elliptical aperture 135 is expressed by C3 and is made equal to 2.75 mm, one-half of the minor axis of the elliptical apertures 145 is expressed by C4 and is made equal to 3.2 mm, one-half of the minor axis of an outer semielliptical aperture provided in the electrode plate 133 is expressed by b3 and is made equal to 2.7 mm, one-half of the minor axis of an outer semielliptical aperture provided in the electrode plate 143 is expressed by b4 and is made equal to 2.8 mm, the distance S between the central beam and an outer beam is made equal to 6.6 mm, the horizontal dimension h3 of the opening of the envelope 131 is made equal to 21.0 mm, the horizontal dimension h4 of the opening of the envelope 141 is made equal to 20.8 mm, the vertical dimension v3 of the opening of the envelope 131 is made equal to 9.4 mm, the vertical dimension v4 of the opening of the envelope 141 is made equal to 9.4 mm, the amount of recess of the electrode plate 133 is expressed by d3 and is made equal to 2.5 mm, and the amount of recess of the electrode plate 143 is expressed by d4 and is made equal to 1.5 mm.

Further, the cross section of each of the envelopes 131 and 141 has the form of a track, and both end portions of each envelope in the horizontal direction have the form of a semicylinder.

In the main lens having the above-mentioned dimensions, the length of the envelope 131 in the axial direction was made equal to 35.6 mm, a focusing voltage of 7 kV was applied to the G3 electrode, and an accelerating voltage of 25 kV was applied to the G4 electrode. Then, the electron beams were focused on the shadow mask which was 340 mm away from the end face of the G3 electrode confronting the G4 electrode. This corresponds to the focusing effect of a bi-potential lens having a diameter of 8.5, and thus it is known that the effective dimension of each lens was increased. Moreover, according to the present embodiment, the halo of outer beams and the astigmatism are eliminated, and thus substantially circular beam spots are formed.

Further, the electrode plates are recessed in the present embodiment. Accordingly, a converging force toward the central beam is given to the outer beams, and thus the STC is achieved.

In the present embodiment, the horizontal dimension h4 of the opening of the envelope 141 is made smaller than the horizontal dimension h3 of the opening of the envelope 131. In the case where the dimension h4 is increased so as to be greater than the dimension h3, the amount of deflection of the outer beams becomes excessive, and the STC is not achieved. Further, the converging effect in the horizontal direction is weakened, and therefore astigmatism is generated. In this case, it is impossible to simultaneously solve these problems by adjusting the dimensions of the G3 and G4 electrodes. In more detail, when the dimensions C3, b3, h3, d4 and v4 are increased, the amount of deflection of the outer beams is decreased but the converging effect in the horizontal direction is weakened. Accordingly, the astigmatism becomes larger. When the dimensions c4, b4, h4, d3 and v3 are increased, the converging effect in the horizontal direction is strengthened but the amount of deflection of the outer beams becomes larger. Accordingly, the STC characteristics are deteriorated. As is evident from the above, in the present embodiment, it is preferable to make the horizontal dimension h4 with respect to the envelope 141 smaller than the dimension h3 with respect to the envelope 131.

In the present embodiment, elliptical apertures are used. However, other non-circular apertures whose vertical dimension is larger than the horizontal dimension, can also eliminate the astigmatism.

Figure 5:
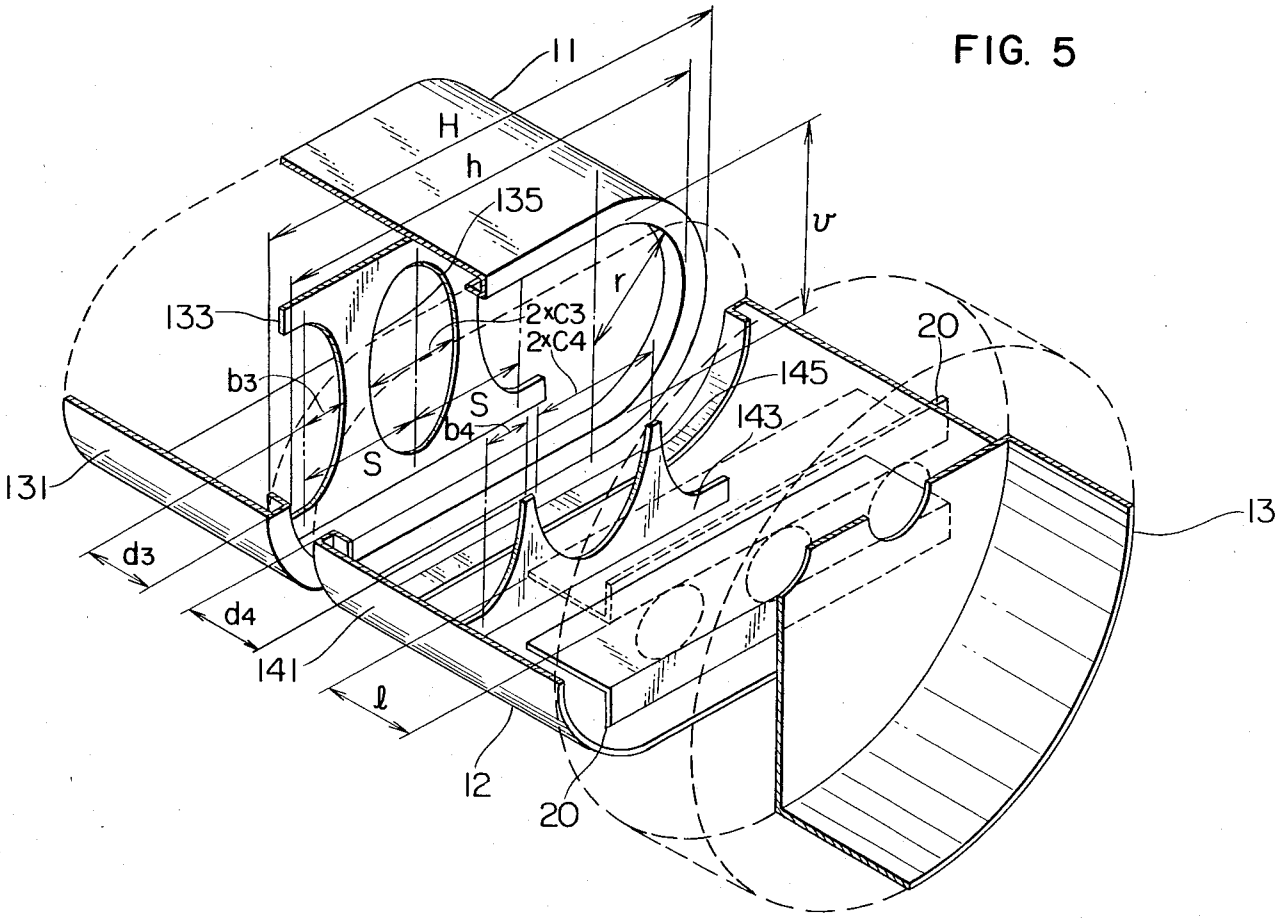
FIG. 5 is a partially cutaway view in perspective of a principal portion of a second embodiment of an electron gun according to the present invention.

FIG. 5 is a partially cutaway view in perspective of a second embodiment of an electron gun according to the present invention. The present embodiment is superior to the first embodiment shown in FIG. 4, in the mass-productivity of electron gun, withstand voltage characteristics, and convergence characteristics. Actual dimensions of the present embodiment will be described below, by way of example. Referring to FIG. 5, one-half of the minor axis of the elliptical aperture 135, namely, C3 is made equal to 2.2 mm, one-half of the minor axis of the elliptical aperture 145, namely, C4 is made equal to 2.7 mm, one-half of the minor axis of an outer semielliptical aperture provided in the electrode plate 133, namely, b3 is made equal to 2.2 mm, one-half of the minor axis of an outer semielliptical aperture provided in the electrode plate 143, namely, b4 is made equal to 2.3 mm, the distance S between the straight path of an outer beam and the path of the central beam is made equal to 5.5 mm, the horizontal dimension h of the opening of each of the envelopes 131 and 141 is made equal to 19 mm, the horizontal outer dimension H of the envelopes 131 and 141 is made equal to 21 mm, the vertical dimension v of the opening of each of the envelopes 131 and 141 is made equal to 8 mm, the amount of recess of the electrode plate 133, namely, d3 is made equal to 3.5 mm, and the amount of recess of the electrode plate 143, namely, d4 is made equal to 2.5 mm.

As mentioned above, in the present embodiment, the distance S between the central beam and an outer beam is made equal to 5.5 mm. This value is smaller than the value of S (=6.6 mm) in the first embodiment. On this account, the STC can be readily realized, and moreover it is possible to make small the spread of electron beam due to the deflection aberration which is caused by converging three electron beams at a pheripheral portion of the fluorescent screen (that is, dynamic convergence).

Further, since the value of S is small, the distance between an end portion of each envelope in the horizontal direction and an outer beam can be made large, that is, the horizontal effective dimension of lens for the outer beams does not decrease even when the horizontal dimension of the opening of each envelope is made small. When the horizontal dimension of each envelope is made small, the gap between each envelope and the inner wall of the neck portion of the glass envelope 1 becomes large, and thus the inner wall of the glass envelope is prevented from being damaged by discharge due to the application of a high voltage.

Further, the envelopes 131 and 141 have the same shape. Accordingly, when the electron gun is mass-produced, the number of manufacturing steps can be reduced.

According to the structure of the present embodiment, in some cases, it is impossible to completely eliminate the astigmatism. On this account, it is preferable to provide a pair of brimmed-plate type correction electrodes 20 on the shield cup 13 in such a manner that the correction electrodes are made parallel to the direction of alignment of the electron beams, and the electron beams are sandwiched between the correction electrodes. The length l of the correction electrodes is made equal to 3.0 mm.

Further, the axial length of the G3 electrode (namely, the envelope 131) is made equal to 29 mm, that is, made smaller than the axial length of the envelope 131 in the first embodiment, in order to prevent the axes of the G3 and G4 electrodes from deviating from each other. Thus, the assembling accuracy can be improved.

As mentioned previously, a focusing voltage is applied to the G3 electrode 11, and an accelerating voltage is applied to the G4 electrode 12. The term "just-focus voltage" means the value of the focusing voltage capable of focusing the electron beams on the shadow mask which is 340 mm away from the end face of the envelope 131 confronting the G4 electrode, when the accelerating voltage is made equal to 25 kV. In general, the focusing voltage capable of eliminating the halo from the beam spots is used as the just-focus voltage.

In the present embodiment, when a beam current of 2 mA flows, the just-focus voltage for the central beam is 6.29 kV, and the focusing voltage for eliminating the inward extending halo from the outer beams, that is, the just-focus voltage for an outer portion of each outer beam is 6.19 kV. Accordingly, when a halo is eliminated from the central beam, the inward extending halo is simultaneously eliminated from the outer beams. That is, the present embodiment can solve the problem that the resolution of the color picture tube is deteriorated by the halo of the outer beams.

Further, according to the above-mentioned structure, excellent STC characteristics are obtained.

Figure 6:
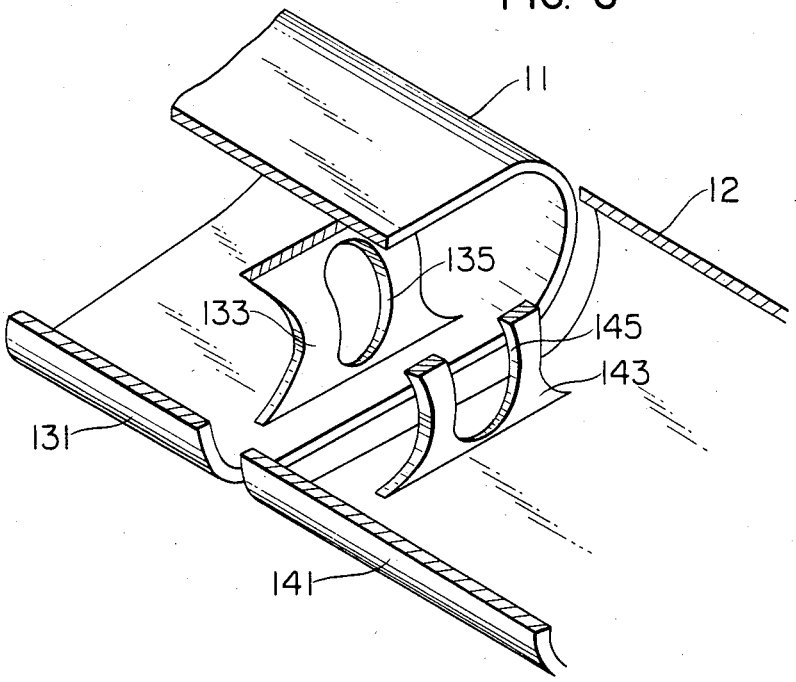
FIGS. 6 and 7 are partially cutaway views in perspective of principal portions of other embodiments of an electron gun according to the present invention.

FIG. 6 shows a third embodiment of an electron gun according to the present invention, in which each of the electrode plates 133 and 143 is bent to vary the amount of recess of each electrode plate continuously. The astigmatism can be eliminated by using such electrode plates. In the present embodiment, it is not always required to make the vertical dimension of the apertures 135 and 145 larger than the horizontal dimension thereof. In the case where the electrode plate 133 of the G3 electrode is convex in the direction toward the G4 electrode as shown in FIG. 6, the converging effect in the horizontal direction is strengthened. While, in the case where the electrode plate 143 of the G4 electrode is convex in the direction toward the G3 electrode, the focusing effect in the vertical direction is strengthened.

Figure 7:
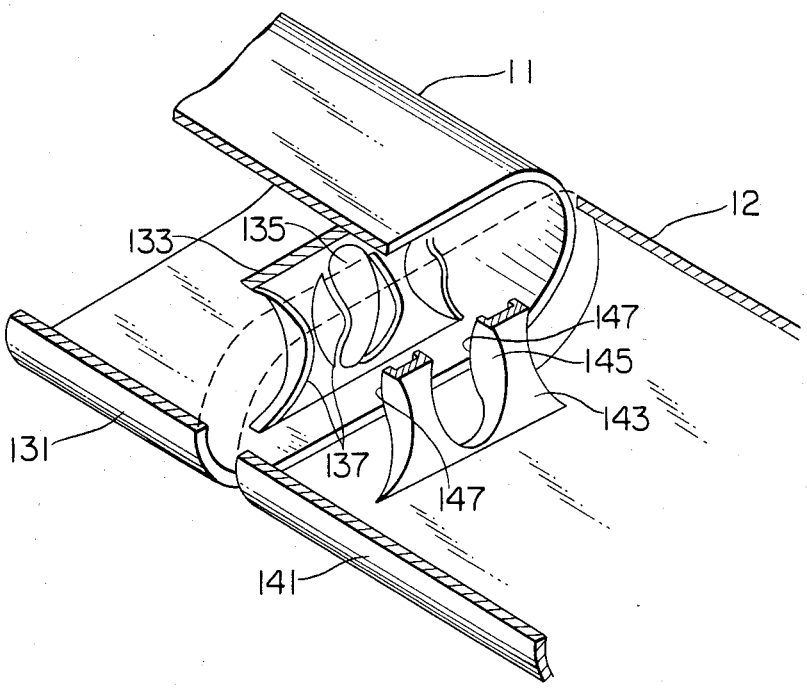

FIG. 7 shows a fourth embodiment of an electron gun according to the present invention, in which the electrode plates 133 and 143 are provided with projections 137 and 147 around the apertures 135 and 145, respectively. The astigmatism can be eliminated by adjusting the thickness of each projection. In the present embodiment, it is not always required to make the vertical dimension of the apertures larger than the horizontal dimension thereof.

In the third and fourth embodiments shown in FIGS. 6 and 7, the astigmatism can be eliminated even when the apertures have the form of a circle. In this case, the machining of parts and the assembling of electrodes can be readily performed, as compared with the case where noncircular apertures are used.

As has been explained in the foregoing, according to the present invention, the inward extending halo is eliminated from the outer beams, the effective dimension of the main lens of the electron gun is sufficiently enlarged, and the focusing characteristics of the color picture tube are improved in a marked degree. Further, the confronting electrode plates of the main lens have a small area, and therefore each electrode plate can be readily made flat by machining. Moreover, since the number of machined portions is relatively small, each electrode plate is readily machined to a desired shape.

Further, the present invention is applicable not only to a bi-potential type main lens which has been used in the foregoing explanation, but also a uni-potential type main lens or main lenses of other types.

In the foregoing explanation, the present invention has been applied to both of a pair of electrode plates constituting the main lens. However, a similar effect is obtained even when the present invention is applied to only one of the electrode plates.

We claim:

1. An electron gun for a color picture tube, comprising:

electron beam generating means for generating three electron beams, said beams being substantially parallel to one another and directed to a fluorescent screen and being arranged so as to define one plane; and a main lens for focusing said three electron beams on said fluorescent screen, said main lens including electrodes spaced apart from each other, said electrodes having:

(a) at least two envelopes surrounding said three electron beams and having opposing ends which confront each other; and (b) electrode plates each disposed on a different one of said envelopes proximate to an opposing end so as to form confronting end faces in said envelopes, each of said electrode plates being shaped such that a single aperture is provided in said electrode plate so that said single aperture surrounds only the center path for the center electron beam among said three electron beams, said electrode plates having end portions configured so that the path for each outer electron beam is partly surrounded by a corresponding one of said end portions, at least one of said electrode plates being provided in one of said envelopes such that said electrode plate is recessed from the end of said one envelope confronting the other envelope.

2. An electron gun for a color picture tube according to claim 1, wherein the dimension of at least one of said apertures provided in said electrode plates is made smaller in a direction parallel to said plane than the dimension thereof in a direction perpendicular to said plane.

3. An electron gun for a color picture tube according to claim 2, wherein at least one of said apertures provided in said electrode plates has the form of an ellipse, and said ellipse has the minor axis in said direction parallel to said plane and has the major axis in the direction perpendicular to said plane.

4. An electron gun for a color picture tube according to claim 3, wherein one of said envelopes is applied with a higher potential than the potential of the other envelope, and the dimension of the opening of said one envelope in said direction parallel to said plane is smaller than the dimension of the opening of said other envelope in said direction parallel to said plane.

5. An electron gun for a color picture tube according to claim 3, wherein one of said envelopes disposed on the fluorescent screen side is provided with a pair of brimmed-plate type correction electrodes at an end of said envelope confronting said fluorescent screen such that said correction electrodes are made substantially parallel to said direction parallel to said plane.

6. An electron gun for a color picture tube according to claim 2, wherein one of said envelopes is applied with a higher potential than the potential of the other envelope, and the dimension of the opening of said one envelope in said direction parallel to said plane is smaller than the dimension of the opening of said other envelope in said direction parallel to said plane.

7. An electron gun for a color picture tube according to claim 2, wherein one of said envelopes disposed on the fluorescent screen side is provided with a pair of brimmed-plate type correction electrodes at an end of said envelope confronting said fluorescent screen such that said correction electrodes are made substantially parallel to said direction parallel to said plane.

8. An electron gun for a color picture tube according to claim 1, wherein at least one of said electrode plates is bent so that the amount of recess of said electrode plate from the end of said corresponding envelope confronting the other envelope is continuously varied.

9. An electron gun for a color picture tube according to claim 8, wherein one of said envelopes is applied with a higher potential than the potential of the other envelope, and the dimension of the opening of said one envelope in said direction parallel to said plane is smaller than the dimension of the opening of said other envelope in said direction parallel to said plane.

10. An electron gun for a color picture tube according to claim 8, wherein one of said envelopes disposed on the fluorescent screen side is provided with a pair of brimmed-plate type correction electrodes at an end of said envelope confronting said fluorescent screen such that said correction electrodes are made substantially parallel to said direction parallel to said plane.

11. An electron gun for a color picture tube according to claim 1, wherein at least one of said electrode plates is provided with a projection around said aperture, and the thickness of said projection is varied continuously along the periphery of said aperture.

12. An electron gun for a color picture tube according to claim 11, wherein one of said envelopes is applied with a higher potential than the potential of the other envelope, and the dimension of the opening of said one envelope in said direction parallel to said plane is smaller than the dimension of the opening of said other envelope in said direction parallel to said plane.

13. An electron gun for a color picture tube according to claim 11, wherein one of said envelopes disposed on the fluorescent screen side is provided with a pair of brimmed-plate type correction electrodes at an end of said envelope confronting said fluorescent screen such that said correction electrodes are made substantially parallel to said direction parallel to said plane.

14. An electron gun for a color picture tube according to claim 1, wherein one of said envelopes is applied with a higher potential than the potential of the other envelope, and the dimension of the opening of said one envelope in said direction parallel to said plane is smaller than the dimension of the opening of said other envelope in said direction parallel to said plane.

15. An electron gun for a color picture tube according to claim 1, wherein one of said envelopes disposed on the flourescent screen side is provided with a pair of brimmed-plate type correction electrodes at an end of said envelope confronting said fluorescent screen such that said correction electrodes are made substantially parallel to said direction parallel to said plane.

16. A color picture tube, comprising:

a glass envelope provided with a fluorescent screen at an end face thereof;

electron beam generating means disposed in said glass envelope for generating three electron beams, said beams being substantially parallel to one another and directed to said fluorescent screen and being arranged so as to define one plane; and a main lens for focusing said three electron beams on said fluorescent screen, said main lens including electrodes spaced apart from each other, said electrodes having:

(a) at least two envelopes surrounding said three electron beams and having opposing ends which confront each other; and (b) electrode plates each disposed on a different one of said envelopes proximate to an opposing end so as to form confronting end faces in said envelopes, each of said electrode plates being shaped such that a single aperture is provided in said electrode plate so that said single aperture surrounds only the center path for the center electron beam among said three electron beams, said electrode plates having end portions configured so that the path for each outer electron beam is partly surrounded by a corresponding one of said end portions, at least one of said electrode plates being provided in one of said envelopes such that said electrode plate is recessed from the end of said one envelope confronting the other envelope.

17. A color picture tube according to claim 16, wherein the dimension of at least one of said apertures provided in said electrode plates is made smaller in a direction parallel to said plane than the dimension of said aperture in a direction perpendicular to said plane.

* * * * *